US005335404A

United States Patent [19]

Ozaki et al.

[11] Patent Number: 5,335,404

[45] Date of Patent: Aug. 9, 1994

[54] METHOD OF FORMING SPACE PORTIONS IN SLIDE FASTENER CHAIN

[75] Inventors: Masahide Ozaki; Makoto Yamazaki; Kenji Dono, all of Toyama, Japan

[73] Assignee: Yoshida Kogyo K.K., Tokyo, Japan

[21] Appl. No.: 111,415

[22] Filed: Aug. 25, 1993

[30] Foreign Application Priority Data

Aug. 26, 1992 [JP] Japan ..... 4-269057

[51] Int. Cl.[5] ..... B21D 53/50

[52] U.S. Cl. ..... 29/408; 29/770; 83/921

[58] Field of Search ..... 29/408, 410, 766, 770, 29/33.2; 83/369, 921

[56] References Cited

U.S. PATENT DOCUMENTS

| | | | |
|---|---|---|---|
| 2,776,466 | 1/1957 | Neitlich | 29/766 |
| 2,846,006 | 8/1958 | Feitl | 83/921 |
| 3,540,090 | 11/1970 | Takamatsu | 29/410 |
| 3,848,500 | 11/1974 | Takahashi | 29/770 |

FOREIGN PATENT DOCUMENTS

| | | | |
|---|---|---|---|
| 0417773 | 3/1991 | European Pat. Off. . | |
| 2574637 | 7/1986 | France . | |
| 775407 | 5/1957 | United Kingdom | 83/921 |
| 1434966 | 5/1976 | United Kingdom . | |
| 2002447 | 2/1979 | United Kingdom . | |

*Primary Examiner*—P. W. Echols

*Attorney, Agent, or Firm*—Hill, Steadman & Simpson

[57] ABSTRACT

A method of forming successive space portion in a slide fastener chain, comprising: positioning the chain in such a manner that an element contiguous to the backward end of a prospective space portion is brought into engagement with a positioning pin upstream of a cutting unit; positioning the chain in such a manner that an element contiguous to the forward end of the prospective space portion is out of engagement with another positioning pin downstream of the cutting unit, and then positioning the chain, as the feed roller is rotated forwardly to extend the chain so that the positioning pin is inserted between the elements, whereupon the downstream positioning pin is brought into engagement with the element adjacent to the prospective space portion as the feed roller is rotated backwardly to restore the slide fastener chain; and cutting off elements of the prospective space portion and removing the cut elements from the prospective space portion.

2 Claims, 2 Drawing Sheets

METHOD OF FORMING SPACE PORTIONS IN SLIDE FASTENER CHAIN

BACKGROUND OF THE INVENTION

1. Field of the Invention

This invention relates to a method of forming a space portion in a continuous slide fastener chain by removing coupling elements from a predetermined length of section of the slide fastener chain, and more particularly to such a space portion forming method in which coupling elements contiguous to opposite ends of a prospective space portion are precisely positioned without being damaged.

2. Description of the Related Art

Conventionally, in forming a space portion in a slide fastener chain, it was difficult to position a prospective space portion precisely due to various causes, such as errors with individual units, extension and shrinkage of opposite fastener tapes, irregular pitches of coupling elements and inertia when stopping the feed of the slide fastener chain, thus resulting in that the coupling elements contiguous to the opposite ends of the prospective space portion would be damaged or partly cut away. In an attempt to eliminate this conventional problem, various positioning concepts have been proposed to correct the position of coupling elements contiguous to the opposite ends of the prospective space portion. These conventional positioning concepts are exemplified by Japanese Patent Laid-Open Publication No. HEI 3-41904, which discloses a space portion forming method having two positioning devices on the upstream side and the downstream side of a prospective space portion respectively, comprising the steps of positioning the slide fastener chain by actuating a second positioning device downstream of the prospective space portion, cutting off a length of row of coupling elements downstream of the prospective space portion using a punch, then positioning the slide fastener chain by actuating a first positioning device upstream of the prospective space portion, and cutting off a length of row of coupling elements upstream of the prospective space portion.

In the conventional space portion forming method, however, since positioning and cutting must take place twice in forming a single space portion, it would be time-consuming and parts such as a punch would be worn away sooner.

SUMMARY OF THE INVENTION

It is an object of this invention to provide a space portion forming method in which a single space portion can be formed by a single cutting operation with simple quick positioning, thus minimizing the wear of parts such as a punch.

According to this invention, there is provided a method of forming successive space portions in a slide fastener chain, comprising the following steps. Firstly, a slide fastener chain is moved by a feed roller disposed on forward side of a prospective space portion and adapted to be driven selectively in one of forward and backward directions, until it arrived at a position right under a coupling element cutting unit. Then the slide fastener chain is positioned, as the feed roller is rotated forwardly, in such a manner that coupling element contiguous to a backward end of a prospective space portion is brought into engagement with a first positioning pin upstream of the coupling element cutting unit. Then the slide fastener chain is positioned in such a manner that a second positioning pin downstream of the coupling element cutting unit which has been set to be out of engagement with a coupling element contiguous to a forward end of the prospective space portion is brought into engagement with the coupling element contiguous to the forward end of the prospective space portion as the feed roller is rotated forwardly by extending the slide fastener chain slightly, and thereupon that the coupling element contiguous to the forward end of the prospective space portion is brought into engagement with the second positioning pin as the feed roller is rotated backwardly. And then, coupling elements of the prospective space portion are cut off and the cut coupling elements are removed from the prospective space portion.

DETAILED DESCRIPTION

One embodiment of this invention will now be described with reference to the accompanying drawings.

Figure 1:
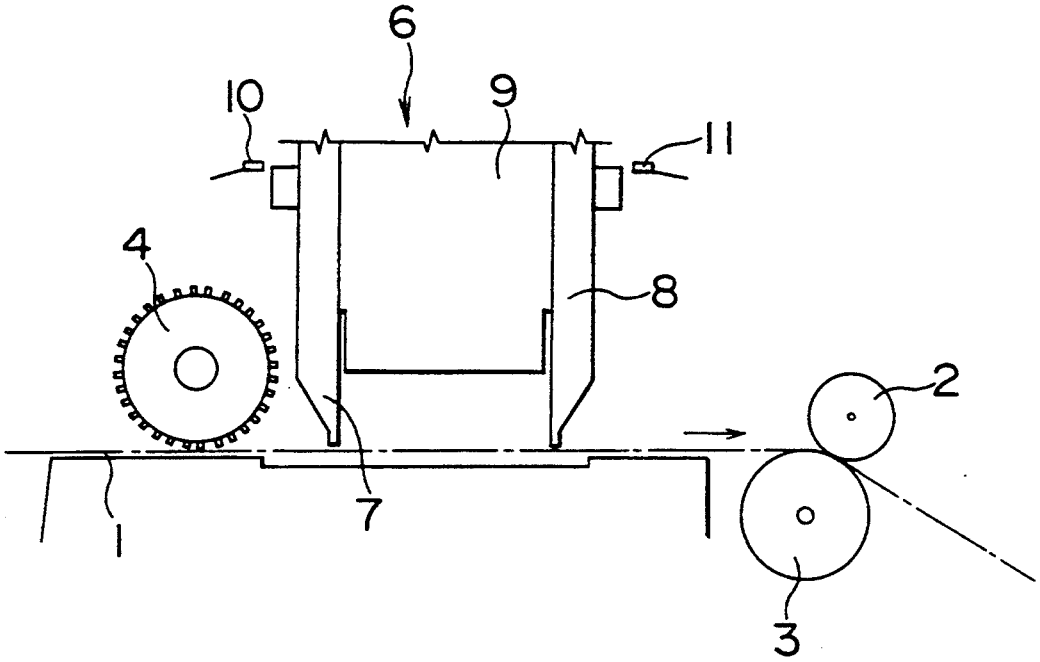
FIG. 1 is a schematic side view of a space portion forming apparatus for carrying out the method of this invention.

FIG. 1 schematically shows a space portion forming apparatus for carrying out a method of forming a space portion in a slide fastener chain according to this invention.

In the space portion forming apparatus, a travelling path of a slide faster chain 1 (hereinafter called "chain") is defined on a base of a frame, and there are situated on the downstream side a pressure roller 2 and a feed roller 3 which is adapted to be directly driven selectively in forward and backward directions to feed the chain 1. On the upstream side, a detection roller 4 is situated for measuring the length of the product in terms of number of coupling elements (hereinafter called "elements") 5 of the chain 1 and for stopping the feed of the chain 1 when a predetermined length of the product has been proceeded. A coupling element cutting unit 6 is situated between the detecting roller 4 and the feed roller 3. A first positioning pin 7 and a second positioning pin 8 are situated upstream and downstream, respectively, of the coupling element cutting unit 6 contiguously thereto. The positioning pins 7, 8 are lowered to insert their distal ends between the elements 5 of the chain 1 to place the chain 1 precisely at a predetermined position, whereupon a punch 9 of the coupling element cutting unit 6 is lowered to cut off a row of the elements 5 to form a space portion. Each positioning pin 7, 8 is equipped with an approach sensor 10, 11 for detecting whether or not the distal end of the respective positioning pin 7, 8 has been inserted between the elements 5. By controlling a drive motor for selective rotation of the feed roller 3 in the forward direction or the backward direction, positioning of the chain 1 is corrected so that any elements 5 are not located at forward and backward ends of the space portion, thus avoiding any partly broken elements remaining on the fastener tapes. Then the punch 9 of the coupling element cutting unit 6 is lowered to cut off the elements 5 within the space portion. This procedure is repeated to form longitudinally spaced successive space portions in a continuous length of slide fastener chain.

Figure 2:
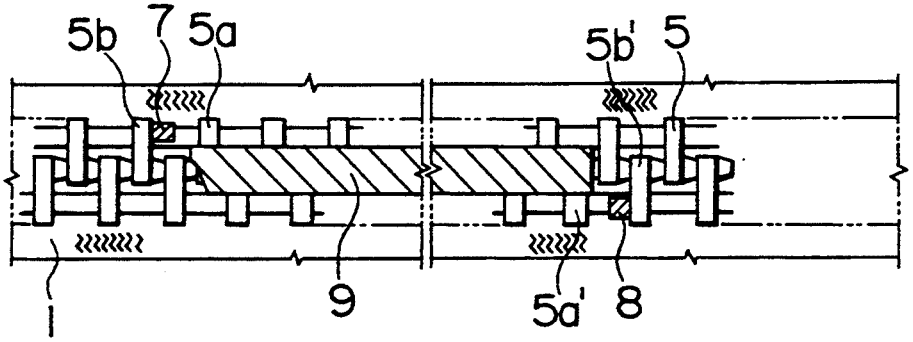
FIG. 2 is an enlarged plan view of a chain, showing the relation between a prospective space portion of the chain, two positioning pins and a punch.
Figure 3:
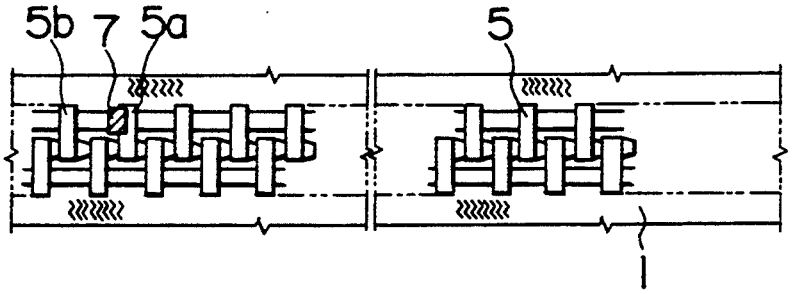
FIG. 3 is an enlarged plan view of the chain, showing the relation between the prospective space portion of the chain and the first positioning pin on the upstream side of the prospective space portion.

Nextly, the space portion forming method carried out on the foregoing apparatus will now be described. In FIG. 1, as the chain 1 is being fed rightwardly by the feed roller 3, the detecting roller 4 counts the number of elements 5 to measure a predetermined length of the product, whereupon a signal is given to the drive motor for the feed roller 3 to stop the feed of the chain 1 in such a manner that a prospective space portion of the chain 1 is set right under the punch 9 of the coupling element cutting unit 6. At that time, if elements 5 are located at the forward and backward ends of the prospective space portion of the chain 1, partly broken elements will remain there when cutting the elements 5 of the prospective space portion takes place. Even though attempts have been made to stop the feed of the chain precisely, the elements 5 would not necessarily stop at a predetermined position due to the pitch error and/or slippage of feed. Consequently the position of the elements 5 must be corrected. Firstly, the first positioning pin 7 on the upstream side is lowered onto the chain 1, then an approach sensor 10 senses the lowered position of the distal end of the first positioning pin 7. As shown in FIG. 2, the feed of the chain 1 is stopped in such a position that the first positioning pin 7 is inserted between an element 5*a* in the backward end of the prospective space portion and an element 5*b* adjacent to the prospective space portion and then comes into engagement with the element 5*b*. But when the distal end of the lowered first positioning pin 7 comes in contact with the leg portion of the element 5*a* as shown in FIG. 3, the approach sensor 10 detects it and send a signal to the drive motor for the feed roller 3 for a slight rotation in the forward direction to feed the chain 1 so that the distal end of the first positioning pin 7 will be inserted between the elements 5*a*, 5*b*. The approach sensor 10 senses this result and sends a signal to the drive motor for the feed roller 3 to stop the forward rotation of the feed roller 3.

Figure 4:
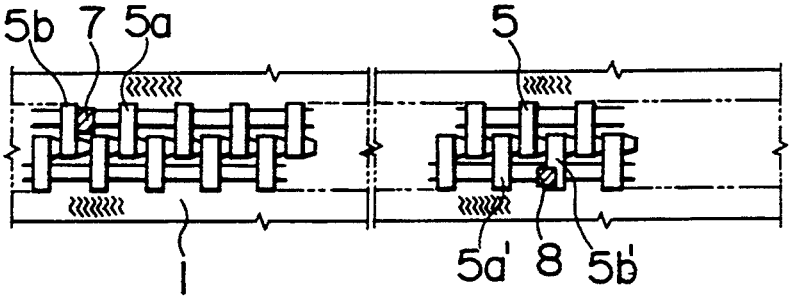
FIG. 4 is an enlarged plan view of the chain, showing the relation between the prospective space portion of the chain and the second positioning pin on the downstream side of the prospective space portion.
Figure 5:
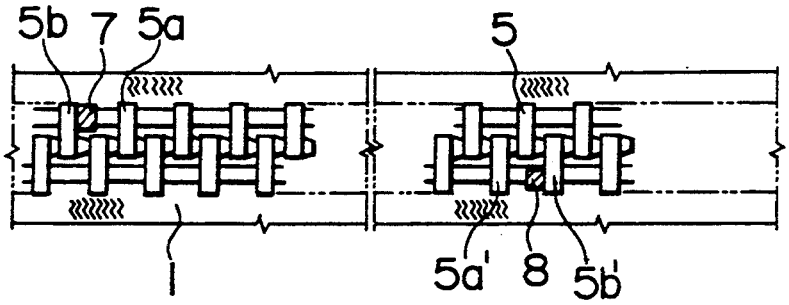
FIG. 5 is an enlarged plan view of the chain, showing the relation between the prospective space portion of the chain and the positioning pins when positioning has been completed.

Subsequently, the second positioning pin 8 on the downstream side is lowered onto the chain 1. The position to which the distal end of the second positioning pin 8 is lowered is preset in such a manner that the distal end will come into contact with the upper surface of the element 5*b*′ which is adjacent to the prospective space portion as shown in FIG. 4. Another approach sensor 11 senses the lowered position of the distal end of the second positioning pin 8 and sends a signal to the drive motor for the feed roller to slightly rotate in the forward direction so as to extend the chain 1, so that the distal end of the first positioning pin 7 will be inserted between an element 5*a*′ in the forward end of the prospective space portion and the element 5*b*′. The approach sensor 11 senses this result and sends a signal to the drive motor for the feed roller 3 to make a slight backward rotation so that the extended chain 1 will be restored to bring the second positioning pin 8 into contact with the side surface of the leg portion of the element 5*b*′. Then the punch 9 of the coupling element cutting unit 6 is lowered to cut off the elements of the prospective space portion. FIG. 2 shows the punch 9 in the lowered position to perform cutting, in which it is clearly shown that the elements 5 outside the space portion will not be broken nor damaged when the punch 9 is lowered to perform cutting. In response to the upward movement of the punch 9, a signal is sent to the drive motor for the feed roller 3 to feed the chain 1 again, thus starting forming the next space portion. This procedure is repeated to form successive space portions spaces at distances of unit product length in a continuous slide fastener chain 1.

The space portion forming method of this invention may be used for any slide fastener chain, such as of the type having metal elements as the illustrated embodiment, the type having synthetic resin elements as injection-molded, and the type having coiled or zigzag-shaped monofilamentary elements, as long as there is defined a gap between each adjacent pair of elements so that the distal end of the positioning pin can be inserted for positioning the chain.

In the method of this invention, after positioning the chain 1 in such a manner that the element 5*b* is in engagement with the first positioning pin 7 on the upstream side of the coupling element cutting unit 6, the second positioning pin 8 on the downstream side of the cutting unit 6 being initially set to be out of engagement with the element 5*b*′ is lowered onto the element 5*b*′, and then a signal is sent to the drive motor to rotate the feed roller 3 forwardly to extend the chain 1 so that the second positioning pin 8 comes into engagement with the element 5*b*′. Then the feed roller 3 is rotated backwardly to bring the positioning pins 7, 8 into engagement with the coupling elements 5*b*, 5*b*′ on the upstream and downstream sides. Therefore, it is possible to position a prospective space portion of the chain 1 at a fixed position, regardless of irregular pitches of elements 5 of the chain 1, so that adjacent elements 5*b*, 5*b*′ are free from any damage during cutting. Further, since the positioning pins 7, 8 are brought into engagement with the elements 5*b*, 5*b*′ by the selective forward and backward rotation of the feed roller 3, it is possible to perform the positioning simply in a short time and also to form a space portion in a single cutting operation, thus causing many advantageous results such as minimizing the wear of parts such as the punch 9.

And further advantageous result is that the extended chain 1 downstream the positioning pin 8 is restored by the backward rotation of the feed roller 3 so that no pulling force by chain 1 is exerted on the detection roller 4 when the coupling element cutting unit 6 is moved upwardly and hence the detection roller 4 works correctly.

What is claimed is:

1. A method of forming successive space portions in a slide fastener chain, comprising the steps of:

(a) moving a slide fastener chain, by a feed roller disposed on forward side of a prospective space portion and adapted to be driven selectively in one of forward and backward directions, until it arrives at a position right under a coupling element cutting unit;

(b) positioning the slide fastener chain, as the feed roller is rotated forwardly, in such a manner that a coupling element contiguous to a backward end of the prospective space portion is brought into engagement with a first positioning pin upstream of the coupling element cutting unit;

(c) positioning the slide fastener chain in such a manner that a second positioning pin downstream of the coupling element cutting unit which has been set to be out of engagement with a coupling element contiguous to a forward end of the prospective space portion is brought into engagement with said coupling element contiguous to the forward end of the prospective space portion as the feed roller is rotated forwardly by extending the slide fastener chain slightly, and thereupon that said coupling element contiguous to the forward end of the prospective space portion is brought into engagement with said second positioning pin as the feed roller is rotated backwardly so as to restore the chain from being extended; and (d) cutting off coupling elements of the prospective space portion and removing the cut coupling elements from the prospective space portion.

2. A method of forming successive space portions in a slide fastener chain according to claim 1, wherein a detection roller is disposed upstream from the coupling element cutting unit so as to detect the length of fed slide fastener chain in order to stop said chain at a predetermined position.

* * * * *